US007638248B2

(12) United States Patent
Fukushima et al.

(10) Patent No.: US 7,638,248 B2
(45) Date of Patent: Dec. 29, 2009

(54) ELECTROPHOTOGRAPHIC PHOTOCONDUCTOR

(75) Inventors: Kotaro Fukushima, Kawanishi (JP); Hisayuki Utsumi, Nara (JP); Tomoko Kanazawa, Kashihara (JP); Katsuya Takano, Yamatokoriyama (JP)

(73) Assignee: Sharp Kabushiki Kaisha, Osaka (JP)

( * ) Notice: Subject to any disclaimer, the term of this patent is extended or adjusted under 35 U.S.C. 154(b) by 486 days.

(21) Appl. No.: 11/593,504

(22) Filed: Nov. 7, 2006

(65) Prior Publication Data

US 2007/0105031 A1 May 10, 2007

(30) Foreign Application Priority Data

Nov. 7, 2005 (JP) ..... 2005-322619
Oct. 17, 2006 (JP) ..... 2006-282860

(51) Int. Cl.
*G03G 5/05* (2006.01)

(52) U.S. Cl. ..... 430/58.85; 430/58.05; 430/59.6

(58) Field of Classification Search ..... 430/58.05, 430/58.85, 59.6
See application file for complete search history.

(56) References Cited

U.S. PATENT DOCUMENTS 4,774,224 A * 9/1988 Campbell ..... 503/227
4,808,505 A * 2/1989 Ueda ..... 430/83
5,972,551 A * 10/1999 Miyauchi et al. ..... 430/78
6,780,554 B2 * 8/2004 Tong et al. ..... 430/58.8
7,416,824 B2 * 8/2008 Kondoh et al. ..... 430/58.85
7,449,269 B2 * 11/2008 Sugimura ..... 430/58.85
2004/0101770 A1 * 5/2004 Obata et al. ..... 430/58.85
2004/0151999 A1 * 8/2004 Mishra et al. ..... 430/58.3
2005/0136349 A1 * 6/2005 Mishra et al. ..... 430/58.05
2006/0222979 A1 * 10/2006 Ishida et al. ..... 430/72
2007/0082282 A1 * 4/2007 Mishra et al. ..... 430/58.05

FOREIGN PATENT DOCUMENTS

| | | |
|---|---|---|
| JP | 02-051162 | 2/1990 |
| JP | 06-043674 | 2/1994 |
| JP | 06-250429 | 9/1994 |
| JP | 07-134430 | 5/1995 |
| JP | 10-069107 | 3/1998 |
| JP | 2000-010320 | 1/2000 |
| JP | 2000-214602 | 8/2000 |
| JP | 2002-006526 | 1/2002 |
| JP | 2004-219922 | 8/2004 |
| JP | 2005-164626 | 6/2005 |

OTHER PUBLICATIONS

Diamond, Arthur S & David Weiss (eds.) Handbook of Imaging Materials, 2nd ed . . New York: Marcel-Dekker, Inc. (Nov. 2001) pp. 145-164.*
English language translation of JP 2002-365820 (2002).*

* cited by examiner

*Primary Examiner*—Christopher RoDee
(74) *Attorney, Agent, or Firm*—Nixon & Vanderhye P.C.

(57) ABSTRACT

An electrophotographic photoconductor containing a conductive substrate and at least a charge generating layer and a charge transporting layer successively layered on the substrate, wherein the charge transporting layer contains a charge transporting material (M) and a binder resin (B) and further has a layered structure composed of a plurality of the charge transporting layers wherein the outermost layer of the charge transporting layers show 50% or higher elastic power ($\eta_{Hu}$) and hardness (Hplast) of plastic deformation in a range from 220 N/mm$^2$ or higher to 275 N/mm$^2$ or lower.

10 Claims, 2 Drawing Sheets

ELECTROPHOTOGRAPHIC PHOTOCONDUCTOR

CROSS-REFERENCES TO RELATED APPLICATIONS

This application is related to Japanese Patent Applications No. 2005-322619 filed on 7 Nov., 2005 and No. 2006-282860 filed on 17 Oct., 2006, whose priority is claimed under 35 USC §119, the disclosure of which is incorporated by reference in its entirety.

BACKGROUND OF THE INVENTION

1. Field of the Invention

The invention relates to an electrophotographic photoconductor to be used for image formation by electrophotography and an image forming apparatus provided with the electrophotographic photoconductor.

2. Description of the Related Art

An electrophotographic image forming apparatus to be used for a copying machine, a printer, a facsimile apparatus (hereinafter, referred to as electrophotographic apparatus in some cases) or the like forms an image through the following electrophotographic process. At first, a photosensitive layer of an electrophotographic photoconductor (hereinafter, simply referred to as photoconductor in some cases) installed in the apparatus is evenly charged at a prescribed potential by an electric charger and exposed to light such as laser beam radiated by exposure means corresponding to image information to form an electrostatic latent image. Next, a developer is supplied to the formed electrostatic latent image from development means for depositing colored fine particles called as a toner, which is a component of the developer, on the surface of the photoconductor to develop the electrostatic latent image and visualize a toner image. Further, the formed toner image is transferred onto a transfer material such as recording paper from the surface of the photoconductor by transfer means and fixed by fixing means.

At the time of transfer operation by the transfer means, the toner on the photoconductor surface is not necessarily entirely transferred and shifted to the recording paper, but partially remains on the photoconductor surface or the paper powder of the recording paper brought into contact with the photoconductor at the time of transfer may remain while being stuck to the photoconductor surface.

The remaining toner and the foreign substances such as the adhering paper powder on the photoconductor surface cause a bad effect on the quality of an image to be formed and therefore they are removed by a cleaning apparatus.

In recent years, cleaner-less techniques have been advanced and the remaining toner is recovered by cleaning function added to development means with no use of exclusive cleaning means: that is, the remaining toner is removed by a cleaning system simultaneously with development. Next, after the cleaning of the photoconductor surface in that manner, static electricity of the photosensitive layer surface is removed by a static eliminator or the like, thereby eliminating the electrostatic latent image.

The electrophotographic photoconductor to be used in such electrophotographic process is composed by layering a photosensitive layer containing photoconductive material on a conductive substrate made of a conductive material. As the electrophotographic photoconductor has been conventionally used an electrophotographic photoconductor using an inorganic photoconductive material (hereinafter, referred to as inorganic photoconductor).

Typical examples of the inorganic photoconductor are selenium type photoconductors having a photoconductive layer containing such as amorphous selenium (a-Se) or an amorphous selenium-arsenic (a-AsSe); zinc oxide type or cadmium sulfide type photoconductors having a photoconductive layer containing zinc oxide (ZnO) or cadmium sulfide (CdS) dispersed together with a sensitizer such as a coloring material in a resin; and amorphous silicon type photoconductors, having a photoconductive layer containing amorphous silicon (a-Si) (hereinafter, referred to as a-Si photoconductor).

However, the inorganic photoconductor has the following disadvantageous points. That is, the selenium type photoconductors and the cadmium sulfide type photoconductors are problematic in the heat resistance and storage stability. Further, selenium and cadmium are toxic to living things including human being and their use is a problem in terms of the environmental pollution and therefore, it is required to collect the photoconductors using them and to properly dispose them after use. Moreover, the zinc oxide type photoconductors are disadvantageously less sensitive and inferior in durability and therefore, they are scarcely used today.

On the other hand, the a-Si photoconductors drawing attention as an environment-friendly inorganic photoconductor are advantageous having high sensitivity and good durability, however since they are disadvantageously produced by a plasma chemical vapor deposition method, it is difficult to evenly form a photosensitive-layer and image defects are easily caused. Further, the a-Si photoconductors are inferior in the productivity and thus the production cost is disadvantageously high.

As described, since inorganic photoconductors have many disadvantageous points, it has been required to develop new photoconductive materials to be used for the electrophotographic photoconductor and accordingly an organic type photoconductive material, that is an organic photoconductor (Organic Photoconductor: abbreviated OPC), has been often used in place of the conventionally used inorganic type photoconductive material.

The electrophotographic photoconductor using an organic type photoconductive material (hereinafter, referred to as organic photoconductor) is rather much advantageous as compared with the inorganic photoconductor in terms of toxicity, production cost, and option of the material planning although having slight problems in the sensitivity, durability, and environmental stability. Further, the organic photoconductor has an advantageous point that its photoconductive layer can be formed by an easy and economical method, for example, by an immersion coating method.

Having many advantageous points as described above, the organic photoconductor tends to be used dominantly for the electrophotographic photoconductor. Further based on the recent investigations and developments, the sensitivity and durability of the organic photoconductor have been improved and today the organic photoconductor has been used for the electrophotographic photoconductor, except special cases.

Particularly, the capability of the organic photoconductor has been remarkably improved by development of a function-separation type photoconductor in which the charge generating function and the charge transporting function are allotted to respectively different substances. That is, the function-separation type photoconductor has an advantageous point in addition to the above-mentioned advantages of the organic photoconductor that the option of selecting materials composing the photoconductive layer is wide and that the production of a photoconductor having desired characteristics is relatively easy.

This function-separation type photoconductor is classified into a layered type and a monolayer type and in a layered type function-separation photoconductor, a layered type photoconductive layer composed of a charge generating layer containing a charge generating substance to which the charge generating function is allotted and a charge transporting layer containing a charge transporting substance to which the charge transporting function is allotted.

The above-mentioned charge generating layer and charge transporting layer are, in general, formed by dispersing the charge generating substance and the charge transporting substance respectively in binder resins, which are binders.

On the other hand, the monolayer type function-separation photoconductor has a monolayer type photoconductive layer formed by dispersing the charge generating substance and the charge transporting substance together in a binder resin.

As the charge generating substance to be used for the function-separation type photoconductor have been investigated many kinds of substances such as phthalocyanine pigments, squarylium coloring materials, azo pigments, perylene pigments, polycyclic quinone pigments, cyanine coloring materials, squaric acid dyes, and pyrylium type coloring materials and various kinds of materials with high light fastness and high charge generating capability have been proposed.

As the charge transporting substance have been developed pyrazoline compounds, hydrazone compounds, triphenylamine compounds, stilbene compounds and moreover, in recent years, pyrene derivatives, naphthalene derivatives, and terphenyl derivatives having condensed polycyclic hydrocarbons as a center mother skeletone have been developed.

A charge transporting substance is required (1) to be stable to light and heat;

(2) to be stable to active substances such as ozone, nitrogen oxide ($NO_x$), and nitric acid generated by corona discharge at the time of charging a photoconductor;

(3) to have high charge transporting capability;

(4) to have high compatibility with an organic solvent and a binder resin; and (5) to be produced easily at a low cost.

However, the above-mentioned conventionally known charge transporting substances satisfy some of these requirements but cannot satisfy them at high level.

Recently, the photoconductor has been required to have high sensitivity as a photoconductor characteristic and the charge transporting substance is required to have particularly high charge transporting capability corresponding to the demands for miniaturization and high speed to electrophotographic apparatus such as digital copying machines and printers. Further in the high speed electrophotographic process, since the time from exposure to development is short, it is required for the photoconductor to be excellent in the photo-response.

If the photo-response of the photoconductor is low, that is, if the decaying speed of the surface potential after the exposure is slow, the remaining potential rises and the photoconductor is used repeatedly in the state that the surface potential is not sufficiently decayed and the surface charge to be removed is not sufficiently eliminated by the exposure to result in undesirable consequence such as early deterioration of the quality of images.

On the other hand, in the function-separation type photoconductor, the charge generated in the charge generating substance by light absorption is transported to the photosensitive layer surface by the charge transporting substance and the surface charge in the portion of the photoconductor radiated with light is removed, so that the photo-response depends on the charge transporting capacity of the charge transporting substance. Accordingly, also in terms of actualization of a photoconductor having sufficient photo-response, the charge transporting substance is required to have high charge transporting capability.

As the charge transporting substance satisfying the above-mentioned requests have been proposed enamine compounds having higher charge transporting capability than that of the above-mentioned conventionally known charge transporting substances (e.g. reference to Japanese Patent Application Laid-Open (JP) No. Hei 2-51162, JP No. Hei 6-43674 and JP No. Hei 10-69107). Further, to improve a hole transporting capability of a photoconductor, addition of a polysilane and an enamine compound having a specified structure to a photosensitive layer is also proposed (e.g. reference to JP No. Hei 7-134430).

In actual use of an electrophotographic apparatus, since the above-mentioned operations of charging, exposure, development, transfer, cleaning, and static elimination are repeated for the photoconductor under various conditions, the photoconductor is required to have environmental stability, electric stability, and durability to external mechanical force in addition to the high sensitivity and excellent photo-response.

Practically, it is required for the photoconductor to have a surface layer hard to be abraded by sliding and friction with a cleaning member or the like. Accordingly, it is made possible to provide a photoconductor excellent in high durability to printing by specifying physical properties of the photoconductor surface satisfying the above-mentioned aims.

Hardness is one of indexes for evaluation of the physical properties of a wide range of materials including the electrophotographic photoconductor surface, particularly for evaluation of mechanical properties. Hardness is defined as the stress of a material when a presser is pushed into the material. It is tried to quantify a mechanical property of a film composing the electrophotographic photoconductor surface by using the hardness as a physical parameter informing the physical property of a material. For example, a scratching strength test, a pencil hardness test, and a Vickers hardness test have been known well as a testing method for measuring the hardness. However, in any hardness test, there are problems in measurements of mechanical properties of a material showing complicated behaviors such as plasticity, elasticity (including delay component) as a film containing an organic matter, or the like.

For example, Vickers hardness test evaluates the hardness by measuring the length of the pressed trace in a film, however it reflects only the plasticity of the film and it cannot precisely evaluate a mechanical property of organic matter which may be deformed at a high elastic deformation ratio. Accordingly, mechanical properties of a film made of organic matter have to be evaluated in consideration of various characteristics.

In the electrophotographic photoconductor having an organic photosensitive layer as the surface layer, for example, plastic power (plastic deformation ratio, $\eta_{plast}$, %) and elastic power (elastic deformation ratio, $\eta_{HU}$, %) are described as the physical properties to be used for judgment of long term abrasion resistance, durability, and operational stability (e.g. reference to JP 2000-10320 and JP 2002-6526).

The plastic power is a percentage of the ratio of the plastic deformation workload to the total of the plastic deformation workload (energy required for the plastic deformation) and the elastic workload (energy required for the elastic deformation).

Further, the elastic power is a percentage of the ratio of the elastic deformation workload to the total of the plastic deformation workload and the elastic workload.

Accordingly, the total of the plastic power and the elastic power becomes 100 (%).

JP 2000-10320 practically describes that the plastic power (plastic deformation ratio) is set to be in a range from 30 to 70% and that the universal hardness (Hu) measured by a universal hardness test standardized in DIN50359-1 is set in a range from 230 to 700 N/mm$^2$. Further, the Document No. 5 describes that such setting in the numerical range prevents mechanical deterioration of the photoconductor surface layer.

However, the numerical range of the plastic power from 30 to 70% is a range covering almost all of organic photosensitive layers containing binder resins used commonly today. Accordingly, even if the plastic power is in the above-mentioned range, it is not necessarily always possible to obtain an organic photosensitive layer excellent in long term abrasion resistance, durability, and operation stability.

Further, JP 2002-6526 described an electrophotographic photoconductor comprising an organic photosensitive layer and a protection layer containing a curable resin as a binder resin on a conductive support and having an elastic power$\eta_{HU}$ (=[plastic deformation workload/(plastic deformation workload+elastic workload)]×100) of the protection layer in a range from 32 to 60%.

However, the numeral value of 32 to 60% for the elastic power means the same as that the plastic power is in a range from 40 to 68% and similarly to JP 2000-10320, it covers almost all of electrophotographic photoconductors having an organic photosensitive layer as the surface layer which have been used today.

Further, the curable resin to be used as the binder resin is also common in technical fields of electrophotographic photoconductors.

Accordingly, JP 2002-6526 does not practically describe the solution means of obtaining an organic photosensitive layer excellent in long term abrasion resistance, durability, and operation stability. Further, the electrophotographic photoconductor of JP 2002-6526 has a problem that formation of the protection layer containing the curable resin leads to the cost up.

Conventionally, it has been tried to increase the ratio of a binder resin to be used for the surface layer or use a resin with a high molecular weight in order to heighten the durability of the electrophotographic photoconductor as the means for increasing the durability to printing. However increase of the resin ratio results in decrease of the relative amount of a charge transporting material in the surface layer and decrease of the sensitivity of the photoconductor and thus it is unsuitable for recent tendency of speed acceleration.

As means for overcoming such defective points, it is proposed to further separate the function of a charge transporting layer and add a type of resin excellent in durability more in the most outer surface layer and compensate sensitivity for a layer underneath (e.g. reference to JP 2000-214602). However, there is no disclosure of surface properties practically controlling the durability. Further, use of a binder resin with a high molecular weight causes increase of the viscosity of a coating solution in an immersion coating method to result in a problem of decreasing productivity.

Further, a polyarylate type resin described in JP 2004-219922 is disclosed to have a type of resin excellent in exhibition of high printing durability, however in terms of the solubility, it is indispensable to use a halogenated benzene such as monochlorobenzene and a specified halogen type organic solvent and in terms of the effect on the health of human being and global environmental preservation, it cannot be denied that the production is limited considerably.

SUMMARY OF THE INVENTION

In order to miniaturize a copying machine and a printer and make them maintenance-free, there is a problem mainly on durability for organic photoconductors presently used for practical applications and therefore, an aim of the invention is to solve the problem and provide a photoconductor usable for a long term.

Inventors of the invention have intensively made various investigations, consequently have found that the problem can be solved by an electrophotographic photoconductor which is obtained by successively layering at least a charge generating layer and a charge transporting layer containing a binder resin and a charge transporting material on a conductive substrate and of which the charge transporting layer have a layered structure composed of a plurality of charge transporting layers of which the outermost charge transporting layer of the electrophotographic photoconductor has elastic power ($\eta_{HU}$) and hardness value of plastic deformation respectively specified ranges in the surface coating hardness test, and these findings have now led to completion of the invention.

That is, the invention provides an electrophotographic photoconductor comprising a conductive substrate and at least a charge generating layer and a charge transporting layer successively layered on the substrate, wherein the charge transporting layer comprises a charge transporting material (M) and a binder resin (B) which contains, as a main component, a compound represented by the general formula (1):

(1)

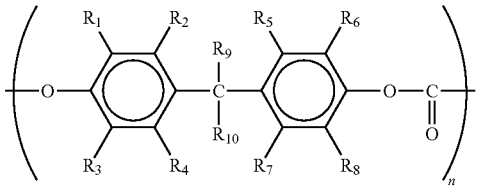

in which $R_1$, $R_2$, $R_3$, $R_4$, $R_5$, $R_6$, $R_7$ and $R_8$, may be the same or different each other and each independently denote a hydrogen atom, a halogen atom, or a substituted or unsubstituted $C_1$ to $C_6$ alkyl group; and $R_9$ and $R_{10}$ may be the same or different each other and each independently denote a hydrogen atom, a halogen atom, a substituted or unsubstituted $C_1$ to $C_6$ alkyl group, a saturated cyclic $C_4$ to $C_{10}$ hydrocarbyl group, or a substituted or unsubstituted aryl group; and n denotes an integer:

and further has a layered structure composed of a plurality of said charge transporting layers wherein the outermost layer of the said charge transporting layers show 50% or higher elastic power ($\eta_{HU}$) measured in the surface coating hardness test by applying a highest pushing load of 5 mN to the surface layer at ambient temperature of 25° C. and at 50% relative humidity and hardness (Hplast) of plastic deformation in a range from 220 N/mm$^2$ or higher to 275 N/mm$^2$ or lower.

Further, the invention provides an electrophotographic photoconductor as described above, in which the charge transporting layer contains a charge transporting material having an enamine structure represented by the following formula (2).

(2)

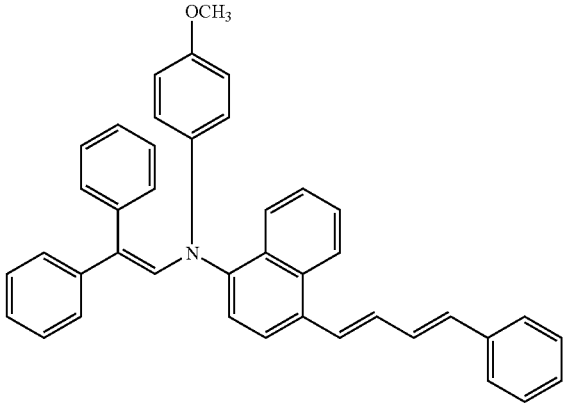

Further, the invention provides an image forming apparatus comprising the above-mentioned electrophotographic photoconductor, charging means for charging the electrophotographic photoconductor, exposure means for exposing the charged electrophotographic photoconductor to light corresponding to the image information for forming an electrostatic latent image, development means for developing a toner image by developing the electrostatic latent image, transfer means for transferring the toner image to a transfer material from the surface of the electrophotographic photoconductor, and cleaning means for cleaning the surface of the electrophotographic photoconductor after the transfer of the toner image.

According to the invention, an electrophotographic photoconductor excellent in both of the electric properties and printing durability and maintaining high durability for a long time can be obtained.

The electrophotographic photoconductor makes it possible to miniaturize a copying machine and a printer, carry out image formation stably for a long duration, and provide an image formation apparatus at a low cost without requiring frequent maintenance.

These and other objects of the present application will become more readily apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

DESCRIPTION OF THE PREFERRED EXAMPLES

The invention is characterized in that the said charge transporting layer comprises a binder resin (B) which contains, as a main component, a compound represented by the general formula (1):

(1)

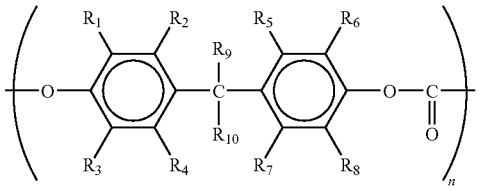

in which $R_1$, $R_2$, $R_3$, $R_4$, $R_5$, $R_6$, $R_7$ and $R_8$, may be the same or different each other and each independently denote a hydrogen atom, a halogen atom, or a substituted or unsubstituted $C_1$ to $C_6$ alkyl group; and $R_9$ and $R_{10}$ may be the same or different each other and each independently denote a hydrogen atom, a halogen atom, a substituted or unsubstituted $C_1$ to $C_6$ alkyl group, a saturated cyclic $C_4$ to $C_{10}$ hydrocarbyl group, or a substituted or unsubstituted aryl group; and n denotes an integer.

In the above general formula (1), examples as a substituent which may substitute the $C_1$ to $C_6$ alkyl group denoted by $R_1$, $R_2$, $R_3$, $R_4$, $R_5$, $R_6$, $R_7$, $R_8$, $R_9$, and $R_{10}$ are $C_1$ to $C_4$ alkyl groups such as methyl, ethyl, propyl, isopropyl, butyl, isobutyl or t-butyl group, and $C_1$ to $C_4$ alkoxy groups such as methoxy, ethoxy, propoxy, isopropoxy, butoxy, isobutoxy or t-butoxy group. Among them, methyl group is preferred.

Examples as the said $C_1$ to $C_6$ alkyl group are $C_1$ to $C_6$ alkyl groups such as methyl, ethyl, propyl, butyl, pentyl and hexyl group, and structural isomer thereof. Among them, methyl group is preferred.

In the above general formula (1), examples of a substituent which may substitute the aryl group denoted by $R_9$ and $R_{10}$ are $C_1$ to $C_4$ alkyl groups such as methyl, ethyl, propyl, isopropyl, butyl, isobutyl or t-butyl group, and $C_1$ to $C_4$ alkoxy groups such as methoxy, ethoxy, propoxy, isopropoxy, butoxy, isobutoxy or t-butoxy group. Among them, methyl group is preferred.

Examples as the said aryl group are aryl groups such as phenyl, tolyl, naphthyl or biphenyl. Among them, phenyl group is preferred.

Examples as the said saturated cyclic C4 to C10 hydrocarbon residue are cyclobutyl, cyclopentyl, cyclohexyl, cycloheptyl, cyclooctyl or decanyl.

In the said general formula (1), n is a integer which denotes a polymerization degree of the compound represented by the formula (1) in which the number average molecular weight (Mn) of the said compound is in the range 20,000 to 100,000, preferably 30,000 to 80,000, determined by GPC (calculated based on polystyrenes).

This is based on following reasons: when the number-average molecular weight (Mn) of the compound of the general formula (1) is less than 20,000, the strength of the photosensitive layer obtained by using the said compound as a binder resin becomes too weak to increase an abrasion wear of the photosensitive layer, and when the said Mn is above 100,000, the binder becomes difficult to dissolve in a solvent due to large number of molecule and deteriorate dispersion properties of each materials.

Figure 1:
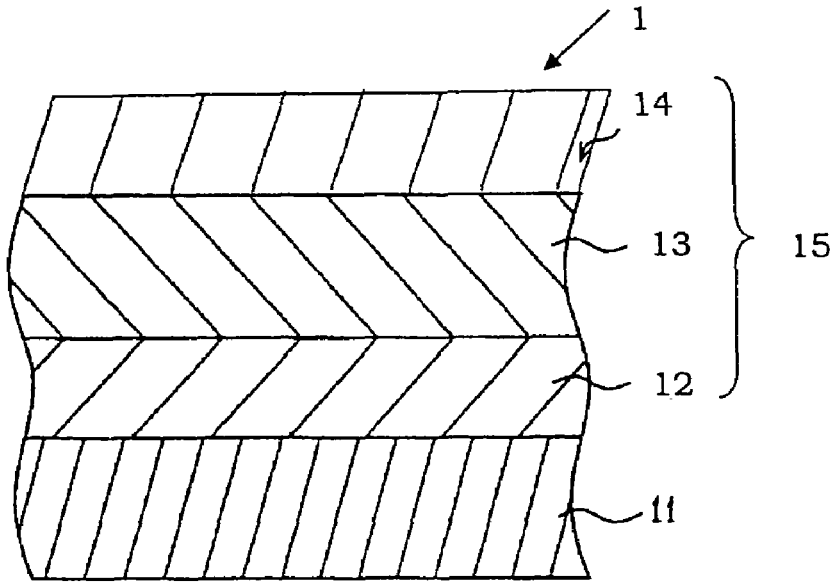
FIG. 1 is a partial cross-sectional view showing a simplified configuration of an electrophotographic photoconductor 1 of an embodiment of the invention.

FIG. 1 is a partial cross-sectional view showing a simplified configuration of an electrophotographic photoconductor 1 of a first embodiment of the invention. The electrophotographic photoconductor 1 (hereinafter, referred to as photoconductor for short) of this embodiment comprises a cylindrical conductive substrate 11 made of a conductive material, a charge generating layer 12 containing a charge generating substance and formed on the outer circumferential face of the conductive substrate 11, and charge transporting layers 13 and 14 containing a charge transporting substance and formed further on the charge generating layer 12. The charge generating layer 12 and the charge transporting layers 13 and 14 compose a photosensitive layer 15. That is, the photoconductor 1 is a layered type photoconductor.

The conductive substrate 11 works as an electrode of the photoconductor 1 and also works as a support member for the respective layers 12, 13, and 14.

The shape of the conductive substrate 11 is cylindrical in this embodiment, however it is not limited to that and may be like a column, sheet or an endless belt.

The conductive material composing the conductive substrate 11 to be used may be metal single substances such as aluminum, copper, zinc, and titanium, and alloys such as an aluminum alloy and a stainless steel. Further, the material may be those obtained by laminating a metal foil on the surface of a polymeric material such as polyethylene terephthalate, nylon, or polystyrene, hard paper, or glass; depositing a metal material on the surface; depositing or forming a layer of a conductive compound such as a conductive polymer, tin oxide, or indium oxide on the surface.

These conductive materials may be used by being machined into a prescribed shape.

If necessary, the surface of the conductive substrate 11 may be subjected to diffused reflection treatment by anodization coating treatment, surface treatment by a chemical, hot water or the like, coloration treatment, or surface roughening within a range not affecting image quality.

In the electrophotographic process using laser as an exposure light source, sine the waveform of the laser beam is even, the laser beam reflected on the photoconductor surface and the laser beam reflected in the inside of the photoconductor are interfered and the interference fringe by the interference sometimes appears on an image to cause an image defect. However, the image defect due to the interference of the laser beam with even waveform can be prevented by execution of the above-mentioned treatment for the surface of the conductive substrate 11.

The charge generating layer 12 contains a charge generating substance generating electric charge by light absorption as a main component.

Substances effective as the charge generating substance may include organic photoconductive materials, for example, azo type pigments such as monoazo type pigments, bisazo type pigments, and trisazo type pigments; indigo type pigments such as indigo and thioindigo; perylene type pigments such as peryleneimide and perylenic acid anhydride; polycyclic quinone type pigments such as anthraquinone and pyrenequinone; phthalocyanine type pigments such as metal phthalocyanine and non-metal phthalocyanine; squarylium coloring materials; pyrylium type salts and thiopyrylium salts; and triphenylmethane type coloring materials and inorganic photoconductive materials such as selenium and amorphous silicon. These charge generating substances may be used alone or two or more of them may be used in form of a mixture.

Among the above charge generating substances, phthalocyanine type pigments are preferable and more particularly, it is preferable to use an oxotitanium phthalocyanine compound represented by the following general formula (A):

(A)

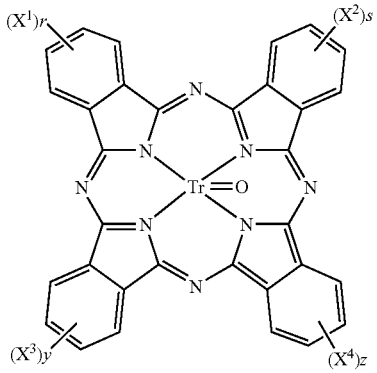

in which $X^1$, $X^2$, $X^3$, and $X^4$ are same or different each other and each independently denote a hydrogen atom, a halogen atom, an alkyl group or an alkoxy group; and r, s, y, and z independently denote an integer from 0 to 4.

In the above general formula (A), example as the halogen atom represented by $X^1$, $X^2$, $X^3$ and $X^4$ is a fluorine, a chlorine, a bromine or an iodine.

Examples as the alkyl group denoted by $X^1$, $X^2$, $X^3$ and $X^4$ is a $C_1$ to $C_4$ alkyl group such as methyl, ethyl, propyl, isopropyl, butyl, isobutyl or t-butyl group.

Examples as the alkoxy group denoted by $X^1$, $X^2$, $X^3$ and $X^4$ is a $C_1$ to $C_4$ alkoxy groups such as methoxy, ethoxy, propoxy, isopropoxy, butoxy, isobutoxy or t-butoxy group.

The oxotitanium phthalocyanine compound represented by the above-mentioned general formula (A) is a charge generating substance having a high charge generation efficiency and a high charge injection efficiency and capable of generating a large quantity of electric charge by absorbing light when being used for the charge generating layer 12 and efficiently injecting the generated electric charge into the charge transporting substance contained in the charge transporting layer 13 without accumulating the generated charge in the inside to smoothly transport the electric charge to the surface of the photosensitive layer 15.

The oxotitanium phthalocyanine compound represented by the above-mentioned general formula (A) can be produced by conventionally known production methods such as a method described in Moser, Frank H and Arthur L. Thomas, "Phthalocyanine Compounds, Reinhold Publishing Corp., New York, 1963.

An example of the oxotitanium phthalocyanine represented by the above-mentioned general formula (A) in which the groups denoted by $X^1$, $X^2$, $X^3$, and $X^4$ are all hydrogen atoms is obtained by heating and melting phthalonitrile and titanium tetrachloride or causing thermal reaction of phthalonitrile and titanium tetrachloride in a proper solvent such as α-chloronaphthalene for synthesizing dichlorotitanium phthalocyanine and thereafter hydrolyzing the dichlorotitanium phthalocyanine in a base or water.

The oxotitanium phthalocyanine can be produced by causing thermal reaction of isoindoline with a titanium tetraalkoxide such as tetrabutoxytitanium in a proper solvent such as N-methylpyrrolidone.

The charge generating substance may be used in combination with a sensitizing dye such as triphenylmethane type dyes represented by Methyl Violet, Crystal Violet, Night Blue, and Victoria Blue; acridine dyes represented by erythrosine, Rhodamine B, Rhodamine 3R, Acridine Orange, and Flaveosine; thiazine dyes represented by Methylene Blue and Methylene Green; oxazine dyes represented by Capryl Blue and Meldras Blue; cyanine type dyes, styryl dyes, pyrylium dyes, and thiopyrylium dyes.

A method for forming the charge generating layer 12 may be a method of depositing the above-mentioned charge generating substance on the surface of the conductive substrate 11 by vacuum evaporation or a method of applying a coating solution for the charge generating layer obtained by dispersing the above-mentioned charge generating substance in a proper solvent to the surface of the conductive substrate 11. A method of preparing a coating solution for the charge generating layer by dispersing the charge generating substance in a binder resin solution obtained by mixing a binder resin, which is a binder, in a solvent in a conventionally known manner and applying the obtained coating solution to the surface of the conductive substrate 11 is preferably used. Hereinafter, the method will be described.

Examples to be used as the binder resin for the charge generating layer 12 may include resins such as polyester resin, polystyrene resin, polyurethane resin, phenol resin, alkyd resin, melamine resin, epoxy resin, silicone resin, acrylic resin, methacrylic resin, polycarbonate resin, polyarylate resin, phenoxy resin, polyvinylbutyral resin, and polyvinylformal resin and copolymer resins containing tow or more repeating units composing these resins.

Practical examples of the copolymer resins may include insulating resins such as vinyl chloride-vinyl acetate copolymer resin, vinyl chloride-vinyl acetate-maleic anhydride copolymer resin, and acrylonitrile-styrene copolymer resin.

The binder resin is not limited to these exemplified resins but may be commonly employed resins. These resins may be used alone or two or more of them may be used in form of a mixture.

Examples to be used as the solvent for the coating solution of the charge generating layer are halogenated hydrocarbons such as dichloromethane and dichloroethane; ketones such as acetone, methyl ethyl ketone, cyclohexanone; esters such as ethyl acetate and butyl acetate; ethers such as tetrahydrofuran and dioxane; alkyl ethers of ethylene glycol such as 1,2-dimethoxyethane; aromatic hydrocarbons such as benzene, toluene, and xylene; and aprotic polar solvents such as N,N-dimethylformamide and N,N-dimethylacetamide. Among these solvents, non-halogen type organic solvents are preferable in terms of the global environmental preservation. These solvents may be used alone or two or more of them may be used in form of a mixture.

The ratio W1/W2 of the weight W1 of the charge generating substance and the weight W2 of the binder resin in the charge generating layer 12 containing the charge generating substance and the binder resin is preferably in a range from ten hundredth (10/100) or higher to four hundred hundredth (400/100) or lower. If the ratio W1/W2 is lower than 10/100, the sensitivity of the photoconductor 1 is lowered and if the ratio W1/W2 exceeds 400/100, it is found that not only the film strength of the charge generating layer 12 is lowered but also the dispersibility of the charge generating substance is lowered to increase coarse particles, so that the surface charge in a portion other than the portion to be eliminated by exposure is lowered to result in image defects and particularly in increase of fogging of images, so-called black flickers, due to deposition of a toner in very small black points in white background. Accordingly, the preferable range of the above-mentioned ratio W1/W2 is set in a range from 10/100 or higher to 400/100 or lower.

The charge generating substance may be crushed previously by a crusher before it is dispersed in the binder resin solution.

Examples to be used as the crusher for the crushing treatment may be a ball mill, a sand mill, an attriter, a shaking mill, and a ultrasonic dispersing apparatus.

Further, examples to be used as a dispersing apparatus at the time of dispersing the charge generating substance in the binder resin solution may be a paint shaker, a ball mill, and a sand mill. The dispersion conditions at the time may be selected properly so as to prevent contamination with impurities due to abrasion of containers to be used and the components of the dispersion apparatus.

A coating method of the coating solution for the charge generating layer may be, for example, a spray method, a bar coating method, a roll coating method, a blade method, a ring coating method, and an immersion coating method. An optimum method may be selected among these coating methods in consideration of the physical properties and productivity of the coating.

Especially, the immersion coating method among the coating methods is a method for forming a layer on the surface of a substrate by immersing the substrate in a coating bath filled with a coating solution and successively pulling up the substrate at a constant speed or gradually changed speed and is relatively simple and excellent in the productivity and the cost and therefore the method has been often employed in the case of producing the electrophotographic photoconductor. An apparatus to be used for the immersion coating method may be equipped with a coating solution dispersion apparatus represented by a ultrasonic generating apparatus for stabilizing dispersibility of the coating solution.

The thickness of the charge generating layer 12 is preferably in a range from 0.05 μm or thicker and 5 μm or thinner and more preferably in a range from 0.1 μm or thicker and 1 μm or thinner. It is found that if the thickness of the charge generating layer 12 is thinner than 0.05 μm, the light absorption efficiency is decreased to lower the sensitivity of the photoconductor 1 and if the thickness of the charge generating layer 12 exceeds 5 μm, the charge transfer in the inside of the charge generating layer 12 becomes a speed control step in the elimination of the surface charge of the photosensitive layer 15 to lower the sensitivity of the photoconductor 1.

Accordingly, the preferable range of the thickness of the charge generating layer 12 is set to be from 0.05 μm or thicker to 5 μm or thinner.

The charge transporting layers 13 and 14 are formed on the charge generating layer 12. The charge transporting layer 13 contains a charge transporting substance capable of receiving the electric charge generated by the charge generating substance contained in the charge generating layer 12 and transporting the electric charge and a binder resin for binding the charge transporting substance. Further, the charge transporting layer 14 similar to the charge transporting layer 13 is formed on the charge transporting layer 13.

Examples of the charge transporting substance to be used may be enamine derivatives, carbazole derivatives, oxazole derivatives, oxadiazole derivatives, thiazole derivatives, thiadiazole derivatives, triazole derivatives, imidazole derivatives, imidazolone derivatives, imidazolidine derivatives, bisimidazolidine derivatives, styryl compounds, hydrazone compounds, polycyclic aromatic compounds, indole derivatives, pyrazoline derivatives, oxazolone derivatives, benzimidazole derivatives, quinazoline derivatives, benzofuran derivatives, acridine derivatives, phenazine derivatives, aminostilbene derivatives, triarylamine derivatives, triarylmethane derivatives, phenylenediamine derivatives, stilbene derivatives, and benzidine derivatives. Further, polymers having groups derived from the above-exemplified compounds in main chains or side chains, for example poly(N-vinylcarbazole), poly(1-vinylpyrene), and poly(9-vinylanthracene) are also exemplified.

The binder resin contained in the charge transporting layers 13 and 14 may be selected from resins containing polycarbonates represented by the above-mentioned general formula (1) as a main component.

Specific examples of the resin in which the said polycarbonate is a main component are polycarbonate resin TS2040™ (manufactured by Teijin Chemicals Ltd.), polycarbonate resin GH503™ (manufactured by Idemitsu Kosan Co., Ltd.), polycarbonate resin Z-400™ (manufactured by Mitsubishi Gas Chemical Company, Inc.).

Among them, the polycarbonate resin TS2040™ (manufactured by Teijin Chemicals Ltd.) is preferred as a binding resin for charge transporting layer 13, because of a solubility into a solvent, an evenness of a layer after formation of a coating, and a superior abrasion resistance.

Further, the polycarbonate resin GH503™ (manufactured by Idemitsu Kosan Co., Ltd.) is preferred as a binding resin for charge transfer layer 14 which is outermost surface layer, because of an abrasion resistance of the said resin itself as well as a superior scuff resistance of charge transfer layer 14 contacting toner, paper and cleaning blade.

Examples usable other than those resins as a second component may be vinyl polymer resins such as poly(methyl methacrylate) resin, polystyrene resin, and poly(vinyl chloride) resin; copolymer resin containing two or more repeating units composing the vinyl polymer resins; polyester resin; polyester carbonate resin, polysulfone resin, phenoxy resin, epoxy resin, silicone resin, polyarylate resin, polyamide resin, polyether resin, polyurethane resin, polyacrylamide resin, and phenol resin. Thermosetting resin obtained by partially crosslinking these resins may also be included.

The ratio M/B by weight of the charge transporting substance (M) and the binder resin (B) in the charge transporting layers 13 and 14 is considerably relevant to the printing durability of the photoconductor as described above. The M/B by weight of the charge transporting layer 14 (the outermost surface layer) is 30/70 or lower and the M/B by weight is more preferably 7/93 or higher and 20/80 or lower. Control of the ratio in the above-mentioned range makes it possible to set the following physical properties of the surface in desired ranges.

The charge transporting layer 13 is desired to increase the M/B by weight in order to surely attain the sensitivity of the photoconductor, that is, to increase the ratio of the charge transporting material and the M/B by weight is preferably 50/50 or higher. On the other hand, in consideration of the uniform coatability of the layer and the solubility of the charge transporting material in the binder resin, increase of the M/B by weight is limited and the limited value is defined according to the type of the charge transporting material.

Accordingly, it is made possible to provide the photoconductor 1 with excellent durability and high sensitivity by properly setting the M/B ratio by weight of the charge transporting layers 13 and 14 in the prescribed ranges.

If necessary, various kinds of additives may be added to the charge transporting layers 13 and 14. For example, to improve film formability, flexibility, and surface smoothness, a plasticizer or a leveling agent may be added to the charge transporting layer 13.

The plasticizer may include dibasic acid esters such as phthalic acid esters; fatty acid esters; phosphoric acid esters; chlorinated paraffins, and epoxy type plasticizers. The leveling agent may include, for example, silicone type leveling agents.

Further, to strengthen the mechanical strength and improve the electrical properties, for example, inorganic compounds such as titanium oxide and fluorine atom-containing polymer fine particles such as tetrafluoroethylene polymer fine particles may be added to the charge transporting layers 13 and 14.

Similarly to the above-mentioned case of forming the charge generating layer 12 by coating, the charge transporting layers 13 and 14 may be formed, for example, by producing a coating solution for charge transporting layers by dissolving a charge transporting substance and a binder resin in a proper solvent and dissolving or dispersing the above-mentioned additives if necessary and applying the obtained coating solution to the charge generating layer 12.

The solvent to be used for the coating solution for the charge transporting layers may be, for example, aromatic hydrocarbons such as benzene, toluene, xylene, and monochlorobenzene; halogenated hydrocarbons such as dichloromethane and dichloroethane; ethers such as tetrahydrofuran, dioxane, and dimethoxymethyl ether; and aprotic polar solvents such as N,N-dimethylformamide. These solvents may be used alone or two or more of them may be used in form of a mixture. The solvent may be also used while being mixed with a solvent such as an alcohol, acetonitrile, or methyl ethyl ketone if necessary. Among these solvents, non-halogen type organic solvents are preferably usable in terms of the global environmental preservation.

A coating method of the coating solution for the charge transporting layers may be, for example, a spray method, a bar coating method, a roll coating method, a blade method, a ring coating method, and an immersion coating method. Especially, the immersion coating method among the coating methods is excellent in various points as described above and therefore it is employed most frequently for forming the charge transporting layers 13 and 14.

The thickness of each of the charge transporting layers 13 and 14 is preferably in a range from 1 μm or thicker and 20 μm or thinner and more preferably in a range from 5 μm or thicker and 15 μm or thinner. The entire thickness of the charge transporting layers 13 and 14 is preferably in a range from 5 μm or thicker and 40 μm or thinner and more preferably in a range from 10 μm or thicker and 30 μm or thinner. It is found that if the entire thickness of the charge transporting layers 13 and 14 is thinner than 5 μm, the charge retaining capability is decreased and if the entire thickness of the charge transporting layers 13 and 14 exceeds 50 μm, the resolution degree of the photoconductor 1 is lowered.

Accordingly, the preferable range of the entire thickness of the charge transporting layers 13 and 14 is set to be from 5 μm or thicker to 40 μm or thinner.

Next, the elastic power $\eta_{HU}$ will be described. In the case where a load is applied to a solid material, the mechanical work load $W_{total}$ consumed during the pushing is used partially for plastic deformation workload $W_{plast}$ and the rest is released as elastic recovery workload (elastic deformation workload) $W_{elast}$ at the time of removing the load.

The elastic recovery workload (elastic deformation workload) $W_{elast}$ include a momentary elastic deformation component and a delayed elastic deformation component.

The elastic power $\eta_{HU}$ expresses the viscoelasticity of a material and particularly a parameter relevant to the elastic restoration. The elastic power $\eta_{HU}$ in this embodiment is calculated as follows.

Figure 3:
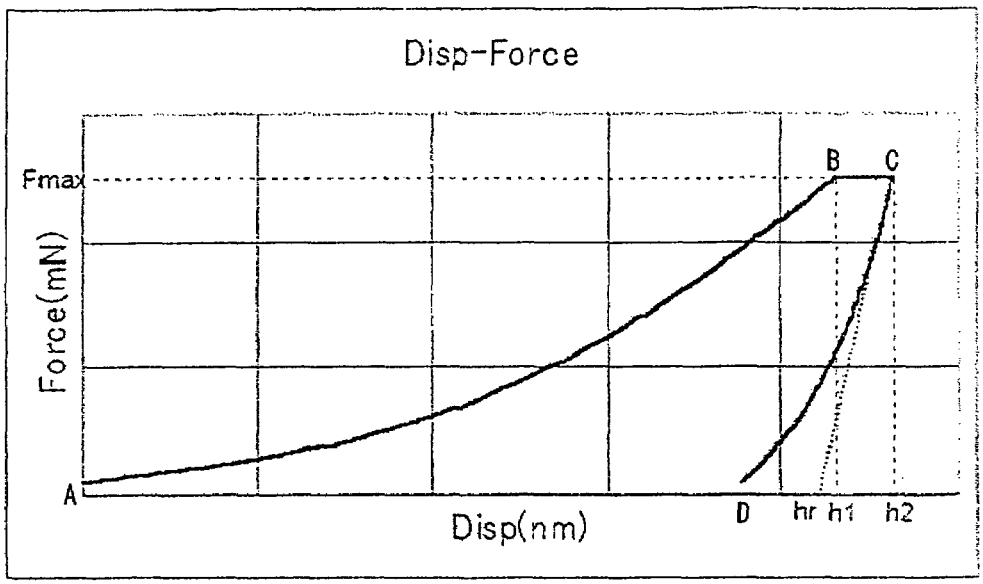
FIG. 3 is a graph for explaining the method for calculating the elastic power $\eta_{HU}$.

The hysteresis line 8 shown in FIG. 3 shows the hysteresis of deformation (pushing depth alteration) of the pushing process from starting the pushing load application to the surface of the photoconductor 1 to the time when the load reaches the prescribed maximum pushing load Fmax (A→B), the load application retention process for keeping the maximum pushing load Fmax for a prescribed time t (B→C), and the load release process from the starting time of releasing the load to the time ending of releasing the load when the load reaches zero (0) (C→D).

Since the mechanical workload $W_{total}$ in the hysteresis line 8 is expressed as $W=\int Fdh$, it is defined as the area encircled by the pushing depth curve (A→B) in load increase and the pushing depth $h_1$. The elastic recovery workload $W_{plast}$ is defined as the area encircled by the pushing depth curve (C→D) in load release and the pushing depth $h_2$. The ratio of the workload is the elastic power $\eta_{HU}$ and defined by the following equation (1):

$$\eta_{HU}=W_{elast}/W_{total}\times 100(\%) \quad (1)$$

wherein $W_{total}=W_{elast}+W_{plast}$.

On the other hand, the hardness value (Hplast) of the plastic deformation is also measured by the same experiment method. That is, in FIG. 3, the plastic hardness Hplast can be calculated from the crossing point: hr of an intercept of the load releasing curve in the process of releasing the load from the maximum pushing point (C) and the X axis.

$$H\text{plast}=F\text{max}/A(hr)$$

wherein Fmax: the maximum pushing load and A(hr): pressed trace surface area at the resilient pushing depth Hr.

The elastic power $\eta_{HU}$ and the hardness Hplast of plastic deformation can be measured by bringing a quadrangular pyramid diamond presser (Vickers presser) into contact with an object and using an instrument capable of evaluating the hysteresis, e.g. Fisher Scope H100 V.

The main factor for high durability for photoconductor is supposed to be effective to minimize the sliding on the photoconductor surface with the cleaning blade and the toner at the time of contact. That is, it is ideal that the photoconductor surface behaves as an elastic body to the force applied to the face at the time of sliding. However, it is difficult to set such a condition for the photoconductor surface made of mainly an organic polymer in terms of the molecular structure and in the case where rubber elasticity is forcibly added (in this case the momentary elasticity is lowered and the delayed elasticity is improved), it is easily assumed that other problems are caused, e.g. the cleaning property is lowered.

On the other hand, improvement of the momentary elasticity of the coating containing mainly a thermoplastic polymer such as polycarbonate generally improves the hardness value of the plastic deformation. However, excess improvement of the hardness results in brittleness and accordingly, leads to density unevenness due to occurrence of scratches and deterioration of the printing resistance of the photoconductor.

Consequently, the inventors of the invention have intensively made investigations taking the above-mentioned material properties of the organic photoconductor surface into consideration and have found it preferable that higher elastic power ($\eta_{HU}$) is 50% or higher and hardness (Hplast) of plastic deformation in a range from 220 N/mm$^2$ or higher to 275 N/mm$^2$ or lower.

The surface coating physical properties of the photoconductor 1 having the above-mentioned configuration, that is, the surface coating physical properties of the photosensitive layer 14 formed in a film-like form, are set so that the elastic power ($\eta_{HU}$) is 50% or higher in the case of measurement by applying a highest pushing load of 5 mN to the surface of the layer at ambient temperature of 25° C. and at 50% relative humidity and hardness Hplast of plastic deformation is in a range from 220 N/mm$^2$ or higher to 275 N/mm$^2$ or lower.

To improve the sensitivity and to suppress increase of residual potential, fatigue etc. due to repeat use, one or more sensitizers such as electron acceptor substances and coloring materials may be added to the respective layers of the photosensitive layer 15.

Examples of the electron acceptor substances to be used are acid anhydrides such as succinic anhydride, maleic anhydride, phthalic anhydride, 4-chlorophthalic anhydride; cyano compounds such as tetreacyanoethylene and terephthalomalondinitrile; aldehydes such as 4-nitorbenzaldehyde; anthraquinones such as anthraquinone and 1-nitoranthraquinone; polycyclic or heterocyclic nitro compounds such as 2,4,7-trinitrofluorene and 2,4,5,7-tetranitrofluorenone; and electron attractive materials such as diphenoquinone compounds. Further, polymerized compounds of these electron attractive materials are also usable.

Further, as the coloring materials can be used organic photoconductive compounds such as xanthene type coloring materials, thiazine type coloring materials, triphenylmethane type coloring materials, quinoline type pigments, and copper phthalocyanine. These organic photoconductive compounds work as an optical sensitizer.

The respective layers 12, 13, and 14 of the photosensitive layer 15 may contain an antioxidant, a UV absorber, or the like. Particularly, it is preferable to add an antioxidant, a UV absorber or the like to the charge transporting layers 13 and 14. Addition of these additives suppresses deterioration by oxidizing gases such as ozone and nitrogen oxide. Further, it can heighten the stability of the coating solution at the time of forming the respective layers by coating.

Examples to be used as the antioxidant may be phenol type compounds, hydroquinone type compounds, tocopherol type compounds, and amine type compounds. Among them, phenol type compounds and amine type compounds are especially preferable and further hindered phenol derivatives and hindered amine derivatives and their mixtures more preferable.

The use amount of these antioxidants is preferably 0.1 parts by weight or more and 50 parts by weight or less in total per 100 parts by weight of the charge transporting substance. It is found that if the use amount per 100 parts by weight of the charge transporting substance as the antioxidant is lower than 0.1 parts by weight, it is impossible to cause efficient effect on improvement of the stability of the coating solution and improvement of the durability of the photoconductor and if it exceeds 50 parts by weight, an adverse effect is caused on the photoconductor properties. Accordingly, a preferable range of the use amount of the antioxidant is set in a range from 0.1 parts by weight or higher to 50 parts by weight or lower per 100 parts by weight of the charge transporting substance.

Figure 2:
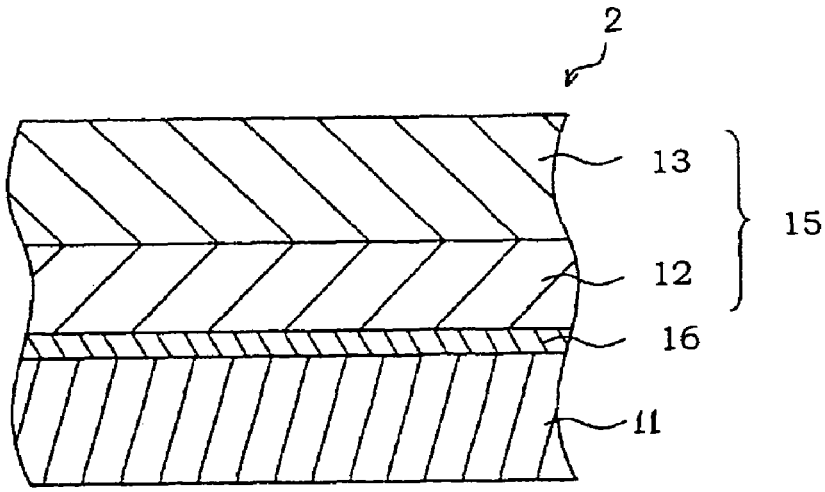
FIG. 2 is a partial cross-sectional view showing a simplified configuration of an electrophotographic photoconductor 2 of an embodiment of the invention.

FIG. 2 is a partial cross-sectional view showing simplified configuration of the electrophotographic photoconductor 2 of a second embodiment of the invention. With respect to the electrophotographic photoconductor 2 of this embodiment, same symbols are assigned to the parts similar and corresponding to those of the electrophotographic photoconductor 1 of the first embodiment and their explanations will be omitted.

The outstanding point in the electrophotographic photoconductor 2 is formation of an intermediate layer 16 between the conductive substrate 11 and the photosensitive layer 15.

In the case where no intermediate layer 16 is formed between the conductive substrate 11 and the photosensitive layer 15, electric charge is injected into the photosensitive layer 15 from the conductive substrate 11 and it leads to decrease of the chargeability of the photosensitive layer 15, decrease of the surface charge in a portion other than the portions to be eliminated by exposure, and generation of defects such as fogging in an image in some cases. Particularly, in the case of forming an image by reverse development process, since toner adhesion to the parts where the surface charge is decreased caused by the exposure forms a toner image, if the surface charge is decreased due to a cause other than the exposure, the toner adheres in form of very small black points in white background to cause fogging of the image, so-called black flickers and the image quality is considerably deteriorated in some cases.

That is, in the case where no intermediate layer 16 is formed between the conductive substrate 11 and the photosensitive layer 15, the chargeability is decreased in very small regions attributed to the defect of the conductive substrate 1 or the photosensitive layer 15 and fogging of the image such as black flickers may be caused to result in noticeable image defects.

In the electrophotographic photoconductor 2 of this embodiment, since an intermediate layer 16 is formed between the conductive substrate 11 and photosensitive layer 15 as described above-mentioned, charge injection to the photosensitive layer 15 from the conductive substrate 11 can be prevented. Accordingly, decrease of the chargeability of the photosensitive layer 15 can be prevented and decrease of the surface charge in a portion other than the portions to be eliminated by exposure can be suppressed and thus occurrence of defects such as fogging of the image can be prevented.

Further, formation of the intermediate layer 16 can cover the defects of the surface of the conductive substrate 11 and make the surface even and accordingly, the formability of the photosensitive layer 15 can be heightened. Separation of the photosensitive layer 15 from the conductive substrate 11 is also prevented and the adhesiveness of the conductive substrate 11 and the photosensitive layer 15 can be improved.

Resin layers containing various kinds of resin materials, an alumite layer, or the like may be used as the intermediate layer 16.

Examples of the resin materials forming the resin layers may be resins such as polyethylene resin, polypropylene resin, polystyrene resin, acrylic resin, vinyl chloride resin, vinyl acetate resin, polyurethane resin, epoxy resin, polyester resin, melamine resin, silicone resin, polyvinyl butyral resin, polyamide resin, and copolymer resins containing two or more repeating units composing these resins. Further, casein, gelatin, polyvinyl alcohol, and ethyl cellulose are also included.

Use of polyamide resin among these resins is preferable and particularly, an alcohol-soluble nylon resin is preferable to use. Preferable examples of the alcohol-soluble nylon resin are so-called copolymer nylon obtained by copolymerization of nylon such as 6-nylon, 6,6,-nylon, 6,10-nylon, 11-nylon, 2-nylon, and 12-nylon and resins obtained by chemically modifying the nylon such as N-alkoxymethyl-modified nylon and N-alkoxyethyl-modified nylon.

The intermediate layer 16 may contain particles such as metal oxide particles. Addition of the particles to the intermediate layer 16 makes it possible to adjust the volume resistance of the intermediate layer 16 and efficiently prevent injection of electric charge to the photosensitive layer 15 from the conductive substrate 11 and at the same time to keep the electric properties of the photoconductor in various environmental conditions.

Examples to be used as the metal oxide particles may be particles of titanium oxide, aluminum oxide, aluminum hydroxide, and tin oxide.

The intermediate layer 16 may be formed, for example, by producing a coating solution for the intermediate layer by dissolving or dispersing the above-mentioned resin in a proper solvent and applying the coating solution to the surface of the conductive substrate 11. In the case of adding the particles such as metal oxide particles to the intermediate layer 16, the intermediate layer 16 may be formed by producing a coating solution for the intermediate layer by dispersing the particles in the resin solution obtained by dissolving or dispersing the above-mentioned resin in a proper solvent and applying the coating solution to the surface of the conductive substrate 11.

A solvent to be used for the coating solution for the intermediate layer may be, for example, a single solvent such as water, methanol, ethanol, or butanol; a mixture of water and alcohol, two or more alcohols, or alcohols with acetone or dioxolane, chlorine-based solvents such as dichloroethane, chloroform, or trichloroethane with alcohols. Among these solvents, non-halogen type organic solvents are preferably usable in terms of the global environmental preservation.

At the time of producing the coating solution for the intermediate layer, a method for dispersing the above-mentioned particle in the resin solution may be a common method using a ball mill, a sand mill, an attriter, a vibration mill, a ultrasonic dispersing apparatus, a paint shaker or the like.

In the coating solution of the intermediate layer, the ratio C/D of the total weight C of the resin and metal oxide and the weight D of the solvent used for the coating solution for the intermediate layer is preferably in a range from (1/99) to (40/60) and more preferably in a range from (2/98) to (30/70). The ratio E/F of the weight E of the resin and the weight F of the metal oxide is preferably in a range from (90/10) to (1/99) and more preferably in a range from (70/30) to (5/95).

An application method of the coating solution for the intermediate layer may include a spray method, a bar coating method, a roll coating method, a blade method, a ring coating method, and an immersion coating method. Especially, the immersion coating method among the coating methods is employed preferably also for the formation of the intermediate layer 16 since the method is relatively simple and excellent in the productivity and the cost.

The thickness of the intermediate layer 16 is preferably in a range from 0.01 μm or thicker to 20 μm or thinner and more preferably in a range from 0.05 μm or thicker and 10 μm or thinner.

It is found that if the thickness of the intermediate layer 16 is thinner than 0.01 μm, the intermediate layer 16 does not practically function well and is insufficient to give uniform surface property of covering the defects of the conductive substrate 11 and to prevent injection of the electric charge to the photosensitive layer 15 from the conductive substrate 1 to lower the chargeability of the photosensitive layer 15. Further it is also found that if the thickness of the intermediate layer 16 exceeds 20 μm, in the case of forming the intermediate layer 16 by the immersion coating method, it becomes hard to form the intermediate layer 16 and impossible to uniformly form the photosensitive layer 15 on the intermediate layer 16 to result in decrease of the sensitivity of the photoconductor and therefore, it is not preferable. Accordingly, a preferable thickness of the intermediate layer 16 is set in a range from 0.01 μm or thicker to 20 μm or thinner.

The production method of the photoconductor of the invention preferably includes a drying step of respective layers, that is, the charge generating layer 12, the charge transporting layers 13 and 14, and the intermediate layer 16. It is found that if the drying temperature of the photoconductor is lower than about 50° C., the drying time is prolonged and if the drying temperature exceeds about 140° C., the electric properties in the case of repeat use may be worsened and images obtained by using the photoconductor may be deteriorated.

Accordingly, the drying temperature of the photoconductor is preferably in a range from about 50° C. to 140° C. and more preferably in a range from about 80° C. to 130° C.

Figure 4:
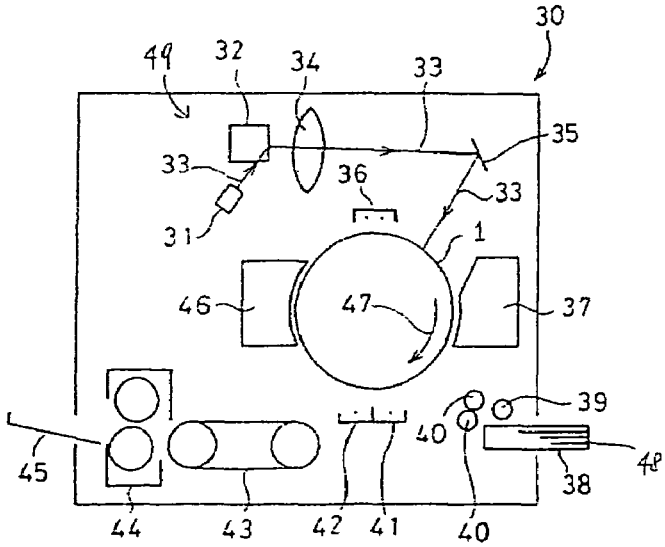
FIG. 4 is a side face drawing of the configuration illustrating a simplified image formation apparatus 30 of the fourth embodiment of the invention.

FIG. 4 is a side face drawing of the configuration illustrating a simplified image formation apparatus 30 of the fourth embodiment of the invention. The image formation apparatus 30 shown in FIG. 4 is a laser printer comprising the photoconductor 1 of the first embodiment of the invention. Hereinafter, with reference to FIG. 4, the configuration of the laser printer 30 and the image formation operation will be explained. The laser printer 30 described in FIG. 4 is an example for explaining the invention, however the image formation apparatus of the invention is not limited only to the following explanations.

The laser printer 30, which is an image formation apparatus, comprises a photoconductor 1, a semiconductor laser 31, a rotating polygonal mirror 32, a lens 34, a mirror 35, a corona charging apparatus 36 which is charging means, a developer 37 which is development means, a transfer sheet cassette 38, a paper feeding roller 39, a resist roller 40, a transfer charging apparatus 41 which is transfer means, a separation charging apparatus 42, a conveyer belt 43, a fixing apparatus 44, a paper discharge tray 45, and a cleaner 46 which is cleaning means. The semiconductor laser 31, the rotating polygonal mirror 32, the lens 34, and the mirror 35 compose exposure means 49.

The photoconductor 1 is disposed in the laser printer 30 in a manner that it can rotate in the direction shown as the arrow 47 by driving means not illustrated. The laser beam 33 emitted from the semiconductor laser 31 is repeatedly scanned in the longitudinal direction (the main scanning direction) on the surface of the photoconductor 1 by the rotating polygonal mirror 32. The lens 34 has f-θ characteristic and reflects the laser beam 33 by the mirror 35 to form an image on the surface of the photoconductor 1 and carry out exposure. The laser beam 33 is scanned as described above while the photoconductor 1 is rotated to form the image and accordingly an electrostatic latent image corresponding to the image information is formed on the surface of the photoconductor 1.

The above-mentioned corona charging apparatus 36, the developer 37, the transfer charging apparatus 41, a separation charging apparatus 42, and the cleaner 46 are arranged in this order from the upstream to the downstream in the rotating direction of the photoconductor 1 shown by the arrow 47.

The corona charging apparatus 36 is installed upstream of the image focused point of the laser beam 33 in the direction of the rotating direction of the photoconductor 1 to evenly charge the surface of the photoconductor 1. Accordingly, the laser beam 33 exposes the surface of the photoconductor 1 which is charged evenly and the charge quantity of the parts exposed by the laser beam 33 and the charge quantity of the un-exposed parts differ from each other to form the above-mentioned electrostatic image.

The developer 37 is installed downstream of the image focused point of the laser beam 33 in the rotating direction of the photoconductor 1 and supplies the toner to the electrostatic latent image formed on the surface of the photoconductor 1 to develop the electrostatic latent image as a toner image. Sheets of the transfer paper 48 housed in the transfer paper cassette 38 is taken out one by one by the paper feeding roller 39 and led to the transfer charging apparatus 41 synchronously with the exposure of the photoconductor 1 by the resist roller 40. The toner image is transferred on the transfer paper 48 by the transfer charging apparatus 41. The separation charging apparatus 42 installed in vicinity of the transfer charging apparatus 41 eliminates static electricity of the transfer paper on which the toner image is transferred and separates the paper from the photoconductor 1.

The transfer paper 48 separated from the photoconductor 1 is conveyed to the fixing apparatus 44 by the conveyer belt 43 and the toner image is fixed by the fixing apparatus 44. The transfer paper 44 on which the image is formed in the above-mentioned manner is discharged toward the paper discharge tray 45. After the transfer paper 48 is separated by the separation charging apparatus 42, the photoconductor 1 kept continuously rotating on is cleaned by removing foreign matter such as the remaining toner and paper powder from the surface by the cleaner 46. After the static electricity is removed by a static elimination lamp, which is not illustrated and installed together with the cleaner 46, from the photoconductor 1 whose surface is cleaned by the cleaner 46, the photoconductor 1 is further kept rotating on and the series of the image formation steps starting from the charging of the photoconductor 1 are repeated.

Since the surface of the photoconductor 1 installed in the laser printer 30 is set to have the surface free energy in the above-mentioned preferable range, in the image formation by the laser printer 30, the toner forming the toner image is easily transferred to the transfer paper 48 from the surface of the photoconductor 1 and scarcely remains as the remaining toner on the photoconductor 1 and the paper powder of the transfer paper 48 in contact with at the time of transfer hardly adheres to the surface of the photoconductor 1.

Further, even if the foreign matter such as the toner and paper powder adheres to the surface of the photoconductor 1, they are easily removed by the cleaning blade of the cleaner 46 installed for cleaning the surface of the photoconductor 1 after the transfer of the toner image.

Accordingly, the polishing power of the cleaning blade can be set lower in the image forming apparatus according to the invention and the contacting force of the cleaning blade with the surface of the photoconductor 1 can be set low, so that the service life of the photoconductor 1 can be prolonged. Further, since the surface of the photoconductor 1 is made free from the adhered foreign matter such as the toner and paper powder after cleaning and is kept clean constantly, it is made possible to form images with good image quality stably for a long duration.

That is, the laser printer 30 which is an image formation apparatus within a scope of the invention is capable of forming images without deteriorating the image quality stably for a long time under varying conditions. The life of the photoconductor 1 is long and the cleaner 46 is made possible to have a simple configuration, so that the image formation apparatus 30 which does not require frequent maintenance can be produced at a low cost. Furthermore, since the electric property is not deteriorated even if the photoconductor 1 is exposed to light, image quality deterioration attributed to exposure of the photoconductor 1 to light can be suppressed at the time of maintenance The laser printer 30, which is an image formation apparatus, described above as the embodiment of the invention is not limited to the configuration illustrated in FIG. 4 and those which employ the photoconductor according to the invention may have any other optional configuration described below.

That is, in the case where the photoconductor has an outer diameter of 40 nm or smaller, the separation charging apparatus 42 may not be installed. Further, the photoconductor 1 may be formed in a form of a process cartridge while being united with at least one of the corona discharging apparatus 36, the developing apparatus 37, and the cleaner 46.

The process cartridge may be, for example, a cartridge in which the photoconductor 1, the corona discharging apparatus 36, the developing apparatus 37, and the cleaner 46 are assembled; a cartridge in which the photoconductor 1, the corona discharging apparatus 36, and the developing apparatus 37 are assembled; a cartridge in which the photoconductor 1 and the cleaner 46 are assembled; and a cartridge in which the photoconductor 1 and the developing apparatus 37 are assembled.

Use of a process cartridge in which some of the components are united in the above-mentioned manner makes maintenance and control of the apparatus easy.

The charging apparatus is not necessarily limited to the corona discharging apparatus 36 and a corotron charging apparatus, a scorotron charging apparatus, a sawtooth charging apparatus, a roller charging apparatus and the like may be used.

The developer 37 may be a contact type or a non-contact type one.

The cleaner 46 may be a blush cleaner.

Further, the timing of applying high potential such as development bias may be adjusted to eliminate the static elimination lamp. That is in the case where the diameter of the photoconductor is small or in the case of a low speed low end printer, it is possible to install no static elimination lamp in terms of save of the installation space.

EXAMPLES

Hereinafter, the invention will be described more in detail with reference to Examples, however it is not intended that the invention be limited to the illustrated Examples.

At first, each of photoconductors of Examples and Comparative Examples was produced by forming a photosensitive layer on a conductive substrate made of aluminum and having a diameter of 30 mm and a length of 340 mm under various conditions and each of the produced photoconductors will be described.

Example 1

At first, 3 kg of a coating solution for an underlayer was produced by dispersing 3 part by weight of TTO-MI-1 (TM, titanium oxide fine particles manufactured by Ishihara Sangyo Kaisha, Ltd.), 3 part by weight of CM-8000 (TM, alcohol-soluble nylon resin, manufactured by Toray Industries, Inc.), 60 part by weight of methanol, and 40 part by weight of 1,3-dioxolane for 10 hours by a paint shaker. The coating solution was applied to a cylindrical support made of aluminum with a diameter of 30 mm and a length of 340 mm in 0.9 μm thickness of the undercoat by an immersion coating method.

Next, 3 kg of a coating solution for a charge generating layer was produced by dispersing 10 part by weight of a butyral resin (TM: S-lec BM-2, manufactured by Sekisui Chemical Co., Ltd.), 1400 part by weight of 1,3-dioxolane, and 15 part by weight of the titanyl phthalocyanine represented by the following general formula (A):

(A)

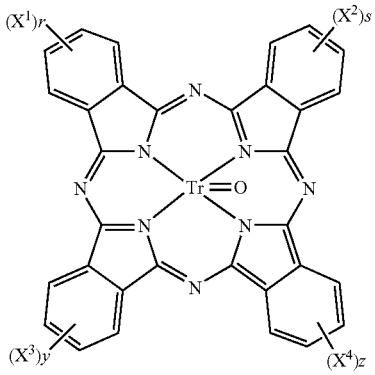

wherein $X^1$, $X^2$, $X^3$, and $X^4$ are the same as defined above; and r, s, y, and z each independently denote 0: by a ball mill for 72 hours. The charge generating layer in a thickness of 0.2 μm was formed using the coating solution by the immersion coating method on the cylindrical support made of aluminum and bearing the above-mentioned undercoat.

Next, a coating solution for a charge transporting layer was produced by mixing 5 part by weight of an enamine type compound represented by the above-mentioned formula (2) as a charge transporting substance (M), 3.4 part by weight of a polycarbonate resin TS 2040 as a binder resin (B) (manufactured by Teijin Ltd.), 0.125 part by weight of Irganox 1010 as an antioxidant (manufactured by Ciba Specialty Chemicals Co., Ltd.), and 32 part by weight of tetrahydrofuran as a solvent (M/B=60/40). Using the coating solution by the immersion coating method, the charge transporting layer in a thickness of 15 μm after heating treatment was formed further on the previously formed charge generating layer. Further, 3 kg of a coating solution for a charge transporting layer was produced by mixing 5 part by weight of an enamine type compound represented by the above-mentioned formula (2) as a charge transporting substance, 45 part by weight of a polycarbonate resin GH 503 as a binder resin (manufactured by Idemitsu Kosan Co., Ltd.), 0.125 part by weight of Irganox 1010 as an antioxidant (manufactured by Ciba Specialty Chemicals), and 200 part by weight of tetrahydrofuran as a solvent and using the coating solution by the immersion coating method, the charge transporting layer was formed on the previously formed charge transporting layer (M/B=10/90). In this case, the heat treatment at a temperature of 130° C. for 1 hour was carried out to adjust the total thickness of the charge transporting layers to be 25 μm and thus the photoconductor of Example 1 was produced.

Example 2

An electrophotographic photoconductor was produced in the same manner as Example 1, except that in the formation of the charge transporting layer as the outermost surface layer, the ratio by weight of the charge transporting substance (M) and the binder resin (B) was changed to be M/B=20/80.

Example 3

An electrophotographic photoconductor was produced in the same manner as Example 1, except that in the formation of the charge transporting layer as the outermost surface layer, the ratio by weight of the charge transporting substance (M) and the binder resin (B) was changed to be M/B=27/73.

Example 4

An electrophotographic photoconductor was produced in the same manner as Example 1, except that in the formation of two charge transporting layers, a butadiene type compound represented by the following formula (3):

(3)

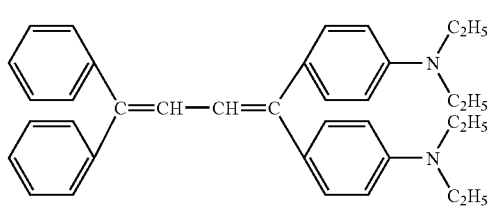

was used as the charge transporting substance.

Example 5

An electrophotographic photoconductor was produced in the same manner as Example 1, except that in the formation of two charge transporting layers, a styryl type compound represented by the following formula (4):

(4)

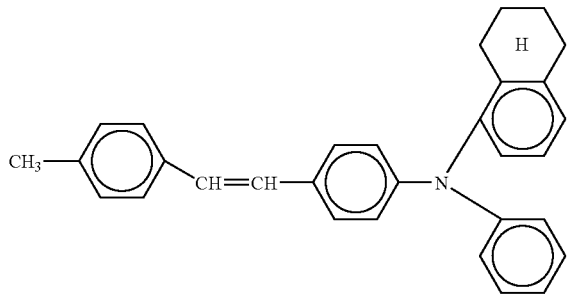

was used as the charge transporting substance.

Comparative Example 1

An electrophotographic photoconductor was produced in the same manner as Example 1, except that that the charge transporting layer was made to be a single layer having the same composition as that of the outermost surface layer of Example 3.

Comparative Example 2

An electrophotographic photoconductor was produced in the same manner as Example 1, except that that the binder resin in the outermost surface layer was changed to 25 part by weight of polycarbonate resin GH 503 (manufactured by Idemitsu Kosan Co., Ltd.) and 20 part by weight of M300 (manufactured by Idemitsu Kosan Co., Ltd.).

Comparative Example 3

An electrophotographic photoconductor was produced in the same manner as Example 1, except that that the ratio M/B by weight of the charge transporting substance (M) and the binder resin (B) in the formation of the outermost surface layer was changed to M/B=35/65.

Comparative Example 4

An electrophotographic photoconductor was produced in the same manner as Example 1, except that that the ratio M/B by weight of the charge transporting substance (M) and the binder resin (B) in the formation of the outermost surface layer was changed to M/B=6/94.

With respect to the respective electrophotographic photoconductors produced in Examples 1 to 5 and Comparative Examples 1 to 4, the charge transporting materials and the binder resins for the charge transporting layers were changes so as to adjust the elastic power $\eta_{HU}$ and the hardness Hplast of plastic deformation in desired values.

These values were measured using Fisher Scope H100 V (manufactured by Fisher Instruments) in ambient atmosphere of temperature at 25° C. and at 50% relative humidity. The measurement conditions were 5 mN of the highest pushing load W, 5 seconds of the time taken to the highest pushing load, 5 seconds of the load holding time t, and 5 seconds of the releasing the load.

Each of the respective photoconductors of Examples 1 to 5 and Comparative Examples 1 to 4 was disposed in a digital copying machine AR-450 (manufactured by Sharp Corp.) modified for the test and image formation was carried out to evaluate the sensitivity, the printing durability, and the image unevenness. Evaluation methods for the respective properties will be described.

[Initial Electrical Property]

The developer was disassembled from the copying machine for the test and a surface potentiometer (344 model: manufactured by Trek Japan) was installed at the development portion instead. Using the copying machine, the surface potential of each photoconductor was adjusted at −650V in the case of no exposure to laser beam in environments of normal temperature/normal humidity (N/N: normal temperature/normal humidity) of 25° C. and at 50% relative humidity and in that state, the surface potential of the photoconductor in the case of exposure to laser beam was measured as the exposure voltage VL (V). As the absolute value of the exposure potential VL was lower, the sensitivity was evaluated as higher.

[Printing Durability]

The pressure of the cleaning blade of the cleaning unit installed in a modified machine AR-450 against the photoconductor, so-called the cleaning blade pressure was adjusted to be 21 gf/cm ($2.06\times10^{-1}$ N/cm) as an initial linear pressure. In N/N environments, a letter test chart was formed on 100,000 sheets of recording paper to carry out the printing durability test for each photoconductor.

The thickness of the photosensitive layer was measured before starting the printing durability test and after the image formation on 100,000 sheets of the recording paper, using a momentary multi-light measurement system MCPD-1100 (manufactured by Otsuka Electronics Co., Ltd.) by a light interference method and the abrasion quantity of the photosensitive layer per 100,000 turns of the photoconductor drum was calculated from the difference of the thickness of the photosensitive layer before starting the printing durability test and after the image formation on 100,000 sheets of the recording paper. As the abrasion quantity was higher, the printing durability was evaluated to be worse.

[Image Density Unevenness]

To investigate the decrease of the image quantity for each photoconductor after the printing durability test, the density unevenness in half-tone images was evaluated. The evaluation standard of the density unevenness was as follows.

<Density Unevenness>

○: no density unevenness was observed in the half-tone images by eye observation: and good images ×: density unevenness was observed in the half-tone images by eye observation: the unevenness was a problematic level for practical use

[Evaluation Results]

The evaluation results obtained in the above-mentioned respective evaluation testes for the respective electrophotographic photoconductors produced in Examples 1 to 5 and Comparative Examples 1 to 4 are shown in Table 1.

TABLE 1

| | Evaluation results | | | | | | | | | | | |
|---|---|---|---|---|---|---|---|---|---|---|---|---|
| | Outermost layer | | | Second surface layer | | | | | Exposure potential | Abrasion quantity of layer | Image | Compre- |
| | CTM | M/B | Thick-ness | CTM | M/B | Thick-ness | $\eta_{HU}$ (%) | Hplast (N/mm$^2$) | (N/N) VL(−V) | (μm/100,000 turns) | (density unevenness) | hensive evaluation |
| Example 1 | Enamine type compound (2) | 10/90 | 10 | Enamine type compound (2) | 60/40 | 15 | 53.1 | 255.2 | 80 | 0.6 | ○ | ◎ |
| Example 2 | Enamine type compound (2) | 20/80 | 10 | Enamine type compound (2) | 60/40 | 15 | 50.9 | 260.5 | 75 | 0.8 | ○ | ◎ |
| Example 3 | Enamine type compound (2) | 27/73 | 10 | Enamine type compound (2) | 60/40 | 15 | 50.2 | 264.7 | 70 | 0.9 | ○ | ○ |
| Example 4 | Butadiene compound (3) | 10/90 | 10 | Butadiene compound (3) | 60/40 | 15 | 50 | 230.5 | 65 | 0.95 | ○ | ○ |
| Example 5 | Styryl type compound (4) | 10/90 | 10 | Styryl type compound (4) | 60/40 | 15 | 52.5 | 257.1 | 95 | 0.7 | ○ | ○ |
| Comparative Example 1 | Enamine type compound (2) | 27/73 | 25 | | | 0 | 50.4 | 266.4 | 180 | 0.85 | ○ | X |
| Comparative Example 2 | Enamine type compound (2) | 10/90 | 10 | Enamine type compound (2) | 60/40 | 15 | 54.1 | 281 | 90 | 0.5 | X | X |
| Comparative Example 3 | Enamine type compound (2) | 35/65 | 10 | Enamine type compound (2) | 60/40 | 15 | 49 | 271.5 | 60 | 1.5 | ○ | X |
| Comparative Example 4 | Enamine type compound (2) | 6/94 | 10 | Enamine type compound (2) | 60/40 | 15 | 51.5 | 215 | 93 | 1.1 | ○ | X |

In the evaluation of the printing durability shown in Table 1, the photoconductors of Examples 1 to 5 having 50 (%) or higher elastic power ($\eta_{HU}$) of the charge transporting layer in the surface and hardness Hplast of plastic deformation in the range of the invention, that is, in a range from 220 N/mm$^2$ or higher to 275 N/mm$^2$ or lower showed the abrasion quantity per 100,000 turns in a range from 0.60 to 0.95 μm and all were evaluated highly.

Particularly, as shown in Examples 1 and 2, in the case where the M/B ratio by weight of the outermost surface layer was in an optimum range, that is, in a range from 7/93 or higher to 20/80 or lower, the results were especially excellent.

On the other hand, in the case of the photoconductor of Comparative Example 2 having the elastic power ($\eta_{HU}$) in a preferable range but a high hardness Hplast of plastic deformation, the density unevenness of images supposedly attributed to scratches of the photoconductor surface was caused. Further, it is found that in the case of the photoconductor of Comparative Example 1, the sensitivity was very inferior and both of the desired sensitivity and the printing durability were actualized only by sensitivity compensation with a second surface layer formed by forming a plurality of charge transporting layers within a scope of the invention.

On the other hand, it is found that with respect to the photoconductors of Comparative Examples 3 and 4 whose physical properties were out of the ranges of the invention, the abrasion quantity per 100,000 turns exceeded 1 μm, showing a problem of printing durability.

In comparison of the photoconductors of Example 1 and Example 5, it could be confirmed that the photoconductor using the enamine type compound was provided with better sensitivity.

As described above, in the case where a plurality of charge transporting layers are formed; the elastic power of the outermost layer is set to be 50% or higher; the hardness Hplast of plastic deformation is set in a range from 220 N/mm$^2$ or higher to 275 N/mm$^2$ or lower; the ratio M/B by weight is controlled preferably; and a preferable enamine type charge transporting material is selected; it is made possible to obtain an electrophotographic photoconductor excellent in printing durability and high photo-response.

According to the invention, if an electrophotographic photoconductor of the invention is disposed in a laser printer, which is an image formation apparatus, image formation free from image quality deterioration can be carried out stably for a long time under various conditions. Further, since the cleaner to be installed can be simplified, an image formation apparatus of the invention can be produced at a low cost and does not require frequent maintenance by disposing the photoconductor with a long life. Moreover, since the electric properties are not deteriorated even if the photoconductor is exposed to light, the image formation apparatus to be obtained using the photoconductor is provided with resistance to image quality deterioration attributed to the exposure of the photoconductor at the time of maintenance.

What is claimed is:

1. An electrophotographic photoconductor comprising a conductive substrate and at least a charge generating layer and a charge transporting layer successively layered on the substrate, wherein the charge transporting layer comprises a charge transporting material (M) and a binder resin (B) which contains, as a main component, a compound represented by the general formula (1):

(1)

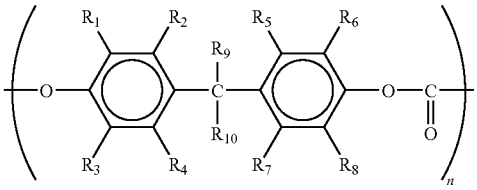

in which $R_1$, $R_2$, $R_3$, $R_4$, $R_5$, $R_6$, $R_7$ and $R_8$, may be the same or different each other and each independently denote a hydrogen atom, a halogen atom, or a substituted or unsubstituted $C_1$ to $C_6$ alkyl group; and $R_9$ and $R_{10}$ may be the same or different each other and each independently denote a hydrogen atom, a halogen atom, a substituted or unsubstituted $C_1$ to $C_6$ alkyl group, a saturated cyclic $C_4$ to $C_{10}$ hydrocarbyl group, or a substituted or unsubstituted aryl group; and n denotes an integer:

and further has a layered structure composed of a plurality of said charge transporting layers wherein the outermost layer of the said charge transporting layers shows 50% or higher elastic power ($\eta_{HU}$) measured in the surface coating hardness test by applying a highest pushing load of 5 mN to the surface layer at ambient temperature of 25° C. and at 50% relative humidity and hardness (Hplast) of plastic deformation in a range from 220 $N/mm^2$ or higher to 275 $N/mm^2$ or lower;

wherein the charge transporting material has an enamine structure represented by the following formula (2):

(2)

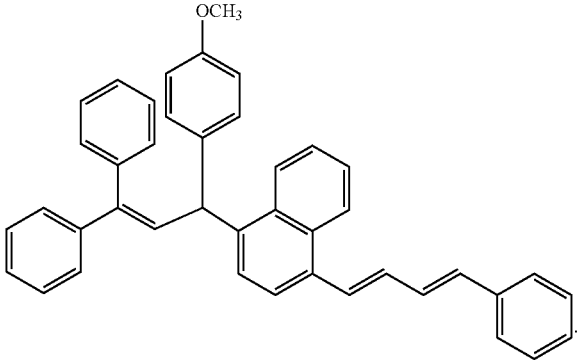

2. The electrophotographic photoconductor according to claim 1, wherein the ratio M/B by weight of the charge transporting material (M) of the outermost layer and the binder resin (B) is 30/70 or lower.

3. An image forming apparatus comprising the electrophotographic photoconductor according to claim 2, charging means for charging the electrophotographic photoconductor, exposure means for exposing the charged electrophotographic photoconductor to light corresponding to the image information for forming an electrostatic latent image, development means for developing a toner image by developing the electrostatic latent image, transfer means for transferring the toner image to a transfer material from the surface of the electrophotographic photoconductor, and cleaning means for cleaning the surface of the electrophotographic photoconductor after the transfer of the toner image.

4. The electrophotographic photoconductor according to claim 1, wherein the ratio M/B by weight of the charge transporting material (M) of the outermost layer and the binder resin (B) is 7/93 or higher and 20/80 or lower.

5. An image forming apparatus comprising the electrophotographic photoconductor according to claim 4, charging means for charging the electrophotographic photoconductor, exposure means for exposing the charged electrophotographic photoconductor to light corresponding to the image information for forming an electrostatic latent image, development means for developing a toner image by developing the electrostatic latent image, transfer means for transferring the toner image to a transfer material from the surface of the electrophotographic photoconductor, and cleaning means for cleaning the surface of the electrophotographic photoconductor after the transfer of the toner image.

6. An image forming apparatus comprising the electrophotographic photoconductor according to claim 1, charging means for charging the electrophotographic photoconductor, exposure means for exposing the charged electrophotographic photoconductor to light corresponding to the image information for forming an electrostatic latent image, development means for developing a toner image by developing the electrostatic latent image, transfer means for transferring the toner image to a transfer material from the surface of the electrophotographic photoconductor, and cleaning means for cleaning the surface of the electrophotographic photoconductor after the transfer of the toner image.

7. An electrophotographic photoconductor comprising a conductive substrate and at least a charge generating layer and a charge transporting layer successively layered on the substrate, wherein the charge transporting layer comprises an enamine charge transporting material (M) and a binder resin (B) which contains, as a main component, a compound represented by the general formula (1):

(1)

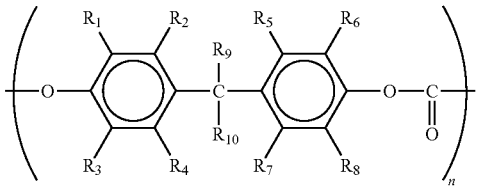

in which $R_1$, $R_2$, $R_3$, $R_4$, $R_5$, $R_6$, $R_7$ and $R_8$, may be the same or different each other and each independently denote a hydrogen atom, a halogen atom, or a substituted or unsubstituted $C_1$ to $C_6$ alkyl group; and $R_9$ and $R_{10}$ may be the same or different each other and each independently denote a hydrogen atom, a halogen atom, a substituted or unsubstituted $C_1$ to $C_6$ alkyl group, a saturated cyclic $C_4$ to $C_{10}$ hydrocarbyl group, or a substituted or unsubstituted aryl group; and n denotes an integer:

and further has a layered structure composed of a plurality of said charge transporting layers wherein the outermost layer of the said charge transporting layers shows 50% or higher elastic power ($\eta_{HU}$) measured in the surface coating hardness test by applying a highest pushing load of 5 mN to the surface layer at ambient temperature of 2500 and at 50% relative humidity and hardness (Hplast) of plastic deformation in a range from 220 $N/mm^2$ or higher to 275 $N/mm^2$ or lower, and wherein the ratio M/B by weight of the charge transporting material (M) of the outermost layer and the binder resin (B) is 7/93 or higher and 20/80 or lower.

8. The electrophotographic photoconductor according to claim 7, wherein the enamine has a structure represented by the following formula (2)

(2)

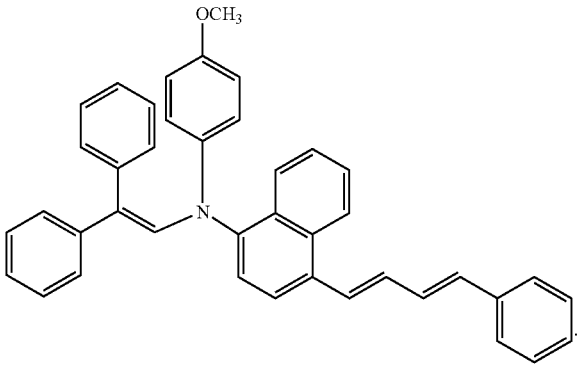

9. An image forming apparatus comprising the electrophotographic photoconductor according to claim 8, charging means for charging the electrophotographic photoconductor, exposure means for exposing the charged electrophotographic photoconductor to light corresponding to the image information for forming an electrostatic latent image, development means for developing a toner image by developing the electrostatic latent image, transfer means for transferring the toner image to a transfer material from the surface of the electrophotographic photoconductor, and cleaning means for cleaning the surface of the electrophotographic photoconductor after the transfer of the toner image.

10. An image forming apparatus comprising the electrophotographic photoconductor according to claim 7, charging means for charging the electrophotographic photoconductor, exposure means for exposing the charged electrophotographic photoconductor to light corresponding to the image information for forming an electrostatic latent image, development means for developing a toner image by developing the electrostatic latent image, transfer means for transferring the toner image to a transfer material from the surface of the electrophotographic photoconductor and cleaning means for cleaning the surface of the electrophotographic photoconductor after the transfer of the toner image.

* * * * *